US008590274B2

(12) United States Patent
Platt

(10) Patent No.: US 8,590,274 B2
(45) **Date of Patent: *Nov. 26, 2013**

(54) SINGLE-LAYERED WEB BEAM FOR A SUSPENDED CEILING

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 915 days.

This patent is subject to a terminal disclaimer.

(21) Appl. No.: 11/446,729

(22) Filed: Jun. 5, 2006

(65) Prior Publication Data

US 2007/0277466 A1 Dec. 6, 2007

(51) Int. Cl.
*E04C 3/04* (2006.01)
*B21D 47/00* (2006.01)

(52) U.S. Cl.
USPC ..... 52/842; 29/897.35

(58) Field of Classification Search
USPC ..... 52/506.07, 729.5, 730.6, 731.7, 733.1, 52/836, 842, 843, 846
See application file for complete search history.

(56) References Cited

U.S. PATENT DOCUMENTS

| | | | | | |
|---|---|---|---|---|---|
| 1,826,133 | A | * | 10/1931 | Hatch | 52/772 |
| 2,065,378 | A | * | 12/1936 | Kling | 52/729.5 |
| 2,092,210 | A | * | 9/1937 | Greulich | 52/729.2 |
| 2,108,373 | A | * | 2/1938 | Greulich | 52/729.5 |
| 3,270,479 | A | | 9/1966 | Weinar | |
| 3,283,467 | A | | 11/1966 | Znamirowski | |
| 3,284,977 | A | | 11/1966 | Lickliter et al. | |
| 3,290,075 | A | | 12/1966 | Jahn | |
| 3,292,332 | A | | 12/1966 | Jahn | |
| 3,319,389 | A | | 5/1967 | Levine | |
| 3,340,662 | A | | 9/1967 | Deinhart et al. | |
| 3,342,515 | A | | 9/1967 | Jahn | |
| 3,356,402 | A | | 12/1967 | Smith | |
| 3,645,051 | A | | 2/1972 | Kolesar | |
| 3,675,957 | A | | 7/1972 | Lickliter et al. | |
| 3,746,379 | A | | 7/1973 | Sauer | |
| 3,778,947 | A | | 12/1973 | Sauer | |
| 3,898,784 | A | | 8/1975 | Sauer et al. | |
| 3,903,671 | A | | 9/1975 | Cuin et al. | |
| 3,921,346 | A | | 11/1975 | Sauer et al. | |
| 4,019,300 | A | | 4/1977 | Sauer et al. | |
| 4,041,668 | A | | 8/1977 | Jahn et al. | |
| 4,064,671 | A | | 12/1977 | Sauer | |
| 4,084,364 | A | | 4/1978 | Jones | |
| RE31,528 | E | * | 3/1984 | Mieyal | 52/730.1 |
| 4,489,529 | A | * | 12/1984 | Ollinger et al. | 52/731.7 |
| 4,492,066 | A | | 1/1985 | LaLonde | |

(Continued)

FOREIGN PATENT DOCUMENTS

EP 0 205 673 A1 12/1986

OTHER PUBLICATIONS

UK Translation of above European Patent 0 205 673 A1, Jahn.

(Continued)

*Primary Examiner* — James Buckle, Jr.
(74) *Attorney, Agent, or Firm* — Eugene Chovanes

(57) ABSTRACT

A balanced, single-layered web beam for a grid in a suspended ceiling, wherein opposing flanges at the bottom of the web are cantilevered directly from the bottom of the web. When the flanges are equally loaded, the resultant load on the beam passes through the vertical plane of the web, so the beam does not twist or bend.

3 Claims, 2 Drawing Sheets

(56) References Cited

U.S. PATENT DOCUMENTS

| | | | | | |
|---|---|---|---|---|---|
| 4,520,609 | A * | 6/1985 | Worley et al. | 52/733.1 |
| 4,531,340 | A * | 7/1985 | Sauer | 52/726.2 |
| 4,554,718 | A * | 11/1985 | Ollinger et al. | 52/506.07 |
| 4,713,919 | A * | 12/1987 | Platt | 52/232 |
| 5,979,055 | A * | 11/1999 | Sauer et al. | 29/897.35 |
| 6,047,511 | A * | 4/2000 | Lehane et al. | 52/506.07 |
| 6,115,986 | A * | 9/2000 | Kelly | 52/731.9 |
| 6,205,733 | B1 * | 3/2001 | LaLonde | 52/506.07 |
| 6,722,098 | B2 * | 4/2004 | Platt | 52/733.1 |
| 7,240,460 | B2 * | 7/2007 | Platt | 52/506.07 |
| 2006/0101763 | A1 * | 5/2006 | Dohren | 52/506.07 |

OTHER PUBLICATIONS

European Patent Office Communication Dated Apr. 9, 2009, Accompanied by Extended European Search Report and Search Opinion, Issued in European Patent Application No. 07010706.5, and European Patents Listed in the European Search Report.

European Search Report (A3 Publication) Issued by European Patent Office in European Patent Application No. 07010706.5. The European Search Was Completed Apr. 1, 2009, and the Publication Date Was May 13, 2009.

* cited by examiner

FIG.1
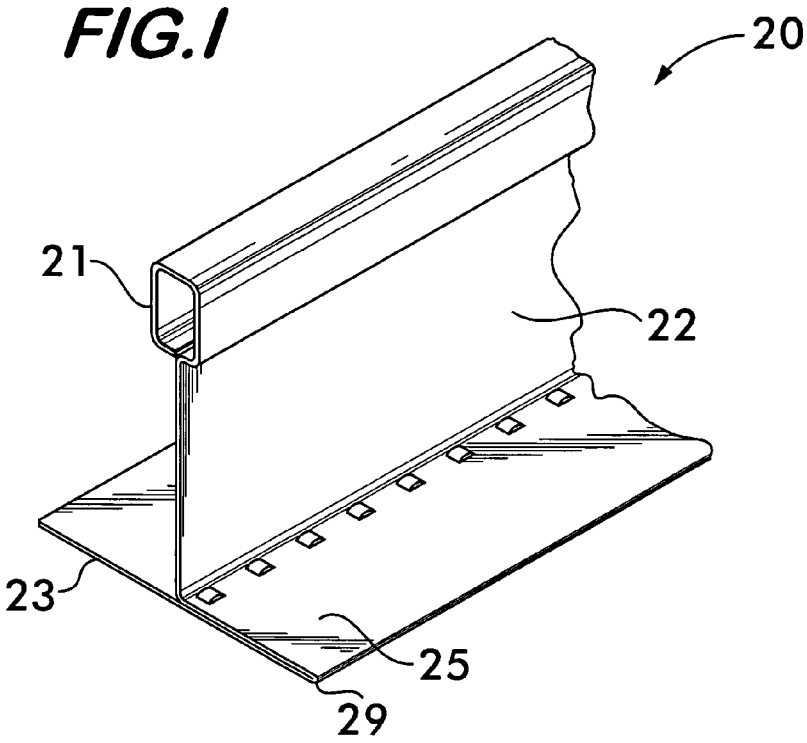
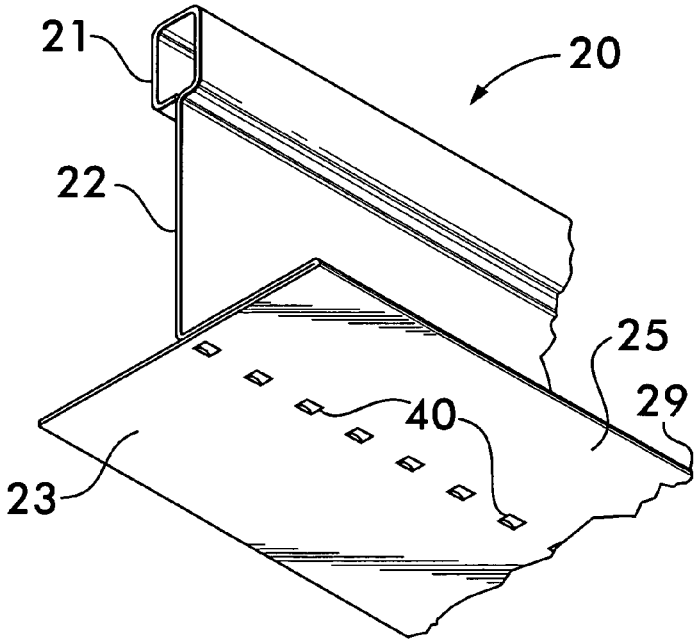
FIG.2

SINGLE-LAYERED WEB BEAM FOR A SUSPENDED CEILING

BACKGROUND OF THE INVENTION

1. Field of the Invention

This invention relates to beams that form a grid in a suspended ceiling. The beams support either panels laid on top of the flanges of the beams, or drywall sheets attached at the bottom of the flanges of the beams.

2. Description of the Related Art

Beams used in grids for suspended ceilings of either the panel or drywall type are well known. Such beams, which are similar for both types of ceilings, are formed into an inverted T cross section by continuously passing a strip of metal through rollers that fold the strip longitudinally.

The beams carry a vertical load on the flanges only. To avoid twisting and bending in tee beams under such vertical load on the flanges in suspended ceilings, beams symmetrical in cross section are used, so that the beam is loaded in the plane of the web. In the prior art, this is done with a double-layered web, having a flange cantilevered from each layer of the web, wherein the flanges oppose one another horizontally.

Beams with a single-layered web have been tried, in an attempt to produce a beam that uses less metal. In such a beam that has a single-layered web, only a single flange is cantilevered from the web. An opposing flange is cantilevered from the first formed flange. Such a beam is unbalanced under a vertical load on both flanges, and is subject to twisting and bending, since it is not loaded in the plane of the web.

In U.S. Pat. Re 31,528, incorporated herein by reference, such problems with single-layered webs are discussed with reference to FIG. 7 of the patent.

In U.S. Pat. No. 4,520,609, attempts were made to balance the cross section of a single-layered web beam by adding more material to the top and bottom of the beam on opposite sides of the web.

In U.S. Pat. No. 4,713,919, a beam having a web with a full first layer, and a partial second layer, is disclosed.

In U.S. Pat. No. 5,979,055, incorporated herein by reference, a beam having a web that is formed partially of one layer, is pieced together.

Such prior art beams with a full, or partial, single-layered web were unbalanced and lacked the necessary strength and stiffness to support the loads, unless more and heavier material was used than in a double-layered web beam. This defeated the desire to use a single-layered web beam with its promise of the use of less metal to make the beam. Virtually all beams for suspended ceilings continue to have a double-layered web.

BRIEF SUMMARY OF THE INVENTION

A balanced beam for a suspended ceiling is formed with a single-layered web that has one flange bent and cantilevered from the bottom of the web, and a second, opposite flange, that is cantilevered from close to the web by a seam that secures the first and second flanges together close to the web.

The seam is preferably formed by continuous stitching as the beam is being rollformed, as seen, for instance, in the '055 patent. Other forms of binding, such as spot, or continuous, welding, as well as adhesives, may be used to form the seam.

Such a beam in cross section is balanced, and acts to load the beam in the plane of the web, so that any twisting or bending in a beam having a single-layered web is substantially eliminated.

The seam also binds the flanges themselves together to produce a bottom member at the base of the single-layered web that stiffens the web itself.

Such a single-layered web beam with a seam in the flanges along the web that binds the flanges together near the bottom of web, so that both flanges are cantilevered from the web, provides the equivalent strength and rigidity of a double-layered web formed of the same thickness of strip metal, but without using a second layer of the metal in the web, so there is less metal needed to make the beam.

BRIEF DESCRIPTION OF THE SEVERAL VIEWS OF THE DRAWING

FIG. 1 is a partial perspective view of the basic single-layered web beam of the invention, taken from above.

FIG. 2 is a partial perspective view of the beam of FIG. 1, taken from below.

DETAILED DESCRIPTION OF THE INVENTION

Beams 20 for suspended ceilings are shown in FIGS. 1 through 5. Such beams include the prior art beams shown in FIGS. 3 and 4, and the single-layered web beam of the invention shown in FIGS. 1, 2, and 5. Beams 20 have a bulb 21 at the top of a web 22. Opposing flanges 23 and 25 extend horizontally away from the web at the bottom of the beam.

Figure 3:
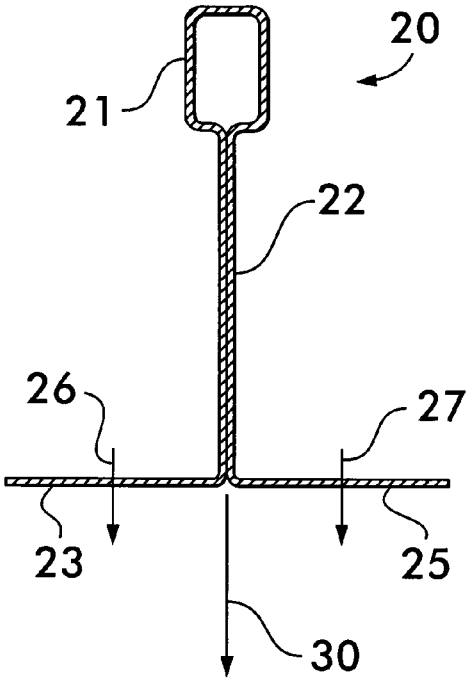
FIG.3 (PRIOR ART)
FIG. 3 is a cross sectional view of a prior art beam with a double-layered web.
Figure 4:
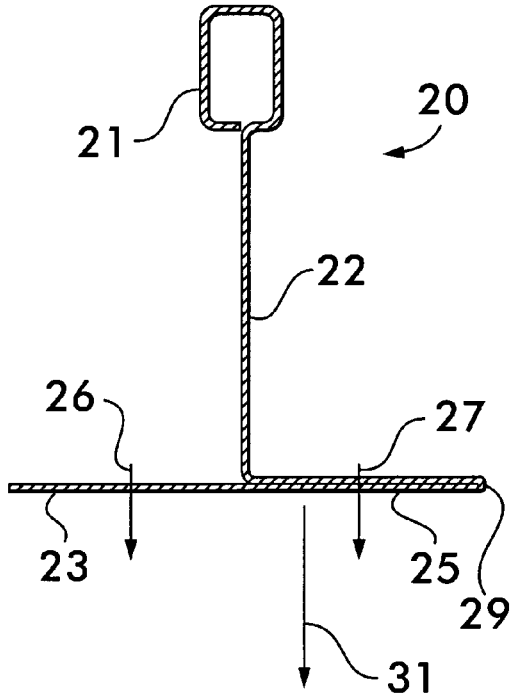
FIG.4 (PRIOR ART)
FIG. 4 is a cross sectional view of a prior art beam with a single-layered web.
Figure 5:
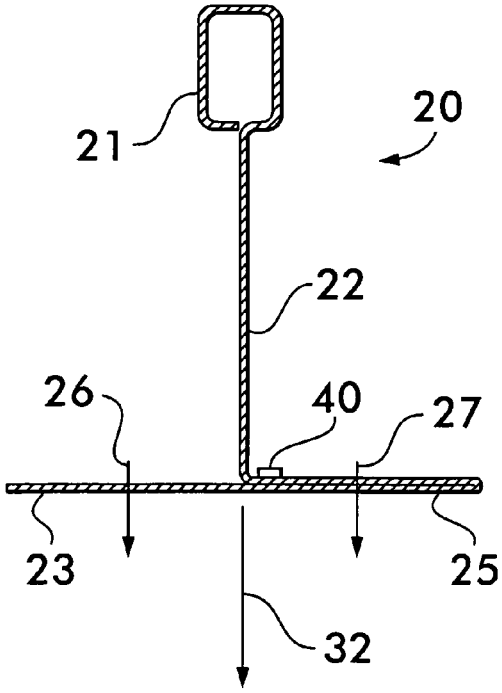
FIG. 5 is a cross sectional view of the beam of the invention.

The vertical panel load, or vertical drywall load, on the beams in a suspended ceiling, is indicated in FIGS. 3 through 5 by vectors that represent the amount, location, and direction of the load exerted by the panels or drywall in a suspended ceiling. The load on each flange is indicated by numbers 26 and 27 on the prior art beams shown in FIGS. 3 and 4, and on the beam of the invention 20 shown in FIG. 5.

The prior art beam 20 shown in FIG. 3 has a two-layered web 22, with each of the flanges 23 and 25 cantilevered from one of the layers of the web 22. The beam is symmetrical, and hence balanced, in cross section.

The prior art beam 20 shown in FIG. 4 has a single-layered web 22 with a flange 25 cantilevered from the bottom of the web 22, to the right, and then a second opposing flange 23 cantilevered from flange 25 at location 29, in a direction to the left.

The basic single-layered web beam 20 of the invention, as seen in FIGS. 1, 2, and 5, has a single-layered web 22, with the flanges formed as in the prior art beam 20 of FIG. 4. The basic single-layered web beam 20 of the invention also has a seam 40 that runs longitudinally along the web 22 of the beam, that binds flanges 23 and 25 together, so that flange 23 is cantilevered from flange 25 along web 22.

The seam 40 is preferably made as the beam is being continuously rollformed, as by stitching. A form of stitching is disclosed in U.S. Pat. No. '055 cited above. A seam 40 could also be formed by continuous or spot welding, or by adhesives.

Seam 40, in effect, cantilevers the flange 23 from the single-layered web 22 of the basic beam of the invention 20, so that the result is a balanced beam that is loaded through the plane of the single-layered web 22. Such basic beam 20 of the invention resists twisting and bending to an extent equivalent to that of a double-layered web beam of a comparable size made of the same thickness metal strip, as seen for instance in FIG. 3. The beam of the invention however, uses less metal.

In FIGS. 3, 4, and 5 of the drawings, the loading of the beams 20, both prior art, and of the invention, is shown through the use of vectors.

In FIG. 3, load vectors 26 and 27 represent the vertical loading on each of the flanges 23 and 25 of a double-layered prior beam 20, in either a panel or a drywall suspended ceiling. The resultant load vector 30 of vectors 26 and 27 of such prior art double-layered web beam passes through the plane of web 22, since the beam is balanced. Such balanced beam creates a maximum resistance to bending and twisting.

In FIG. 4, there is shown the single-layered beam of the prior art. Again, as in FIG. 3, the vectors 26 and 27 represent the loads applied to the beams, either through panel, or drywall, loads. However, because of the beam construction wherein flange 23 is cantilevered from flange 25 at location 29, the resultant load vector 31 is shown applied at a distance away from the single-layered web, resulting in an unbalanced beam subject to bending and twisting that is not present in the balanced beam of FIG. 3.

In FIG. 5, which shows the basic single-layered web beam 20 of the invention, again, as in the prior art, the beam 20 is vertically loaded on the flanges 23 and 25, in the suspended ceiling, as shown by vectors 26 and 27. However, seam 40 binds flange 23 to flange 27 along web 22, so that in effect both flanges 23 and 25 are cantilevered from web 22, resulting in a balanced beam. Load resultant 32 passes through the plane of the web, so that the single-layered beam of the invention resists twisting and bending equivalent to a comparably sized two-layered web beam, as seen in FIG. 3, but with the use of less metal.

What is claimed is:

1. In a beam for a grid in a suspended ceiling, formed from a single layer of metal folded longitudinally into a cross section having (a) a bulb at the top, (b) a single-layered web extending downwardly from the bulb, (c) a first and second flange at the bottom of the web, each of which extends horizontally on the opposite side of the web from the other flange, with the first flange formed of an upper and lower layer of metal, the upper layer of which extends from the bottom of the web, and the second flange formed of at least a single layer of metal extending from the lower layer of the first flange;

the improvement comprising a balanced beam wherein the second flange is cantilevered from the bottom of the web by a binding, so that the resultant load of an equal vertical load on each of the first and second flanges of the beam passes directly through the vertical plane of the web.

2. The beam of claim 1, wherein the binding is formed by a seam of stitches.

3. The beam of claim 1, wherein the binding stiffens the web.

* * * * *